US006679498B2

(12) United States Patent
Barniak, Jr.

(10) Patent No.: US 6,679,498 B2
(45) Date of Patent: Jan. 20, 2004

(54) INDOOR INTERACTIVE TARGET GAME OF SKILL

(76) Inventor: Thomas J. Barniak, Jr., 6011 Lance Rd., Medwa, OH (US) 44256

( * ) Notice: Subject to any disclaimer, the term of this patent is extended or adjusted under 35 U.S.C. 154(b) by 0 days.

(21) Appl. No.: 09/967,825

(22) Filed: Oct. 1, 2001

(65) Prior Publication Data

US 2002/0171202 A1 Nov. 21, 2002

Related U.S. Application Data

(60) Provisional application No. 60/279,517, filed on Mar. 28, 2001.

(51) Int. Cl.[7] ..... A63B 63/00
(52) U.S. Cl. ..... 273/402; 273/317.3
(58) Field of Search ..... 273/317.1, 317.2, 273/317.3, 317.5, 317.8, 357, 388, 385, 402

(56) References Cited

U.S. PATENT DOCUMENTS 713,275 A * 11/1902 Atkins ..... 273/394
2,443,408 A * 6/1948 Walker ..... 124/20.1
3,701,531 A 10/1972 Bowers
3,814,428 A 6/1974 Foley
5,165,694 A 11/1992 Kraushaar
5,242,164 A * 9/1993 Nicoll ..... 273/317.1
5,294,129 A 3/1994 Brown
5,622,369 A 4/1997 Rogers

OTHER PUBLICATIONS

NPL Christian Science Monitor http://www.csmonitor.com/durable/2000/12/26/ page–1 (kid space section) Dec. 26, 2000.*

* cited by examiner

*Primary Examiner*—Paul T. Sewell
*Assistant Examiner*—M. Chambers

(57) ABSTRACT

An indoor interactive competitive game of skill incorporating an arcade-type fixed target and an elastic launching sling using the human body as a yoke and fulcrum to propel soft foam balls to the target containing numerous indicia marked scoring opportunities for the prospect of reaching a predetermined highest score.

4 Claims, 2 Drawing Sheets

INDOOR INTERACTIVE TARGET GAME OF SKILL

CROSS-REFERENCE TO RELATED APPLICATIONS

This patent application claims the benefit of Provisional Patent Application No. 60/279,517 with the filing date of 03/28/2001.

BACKGROUND

1. Field of Invention

The invention relates to an amusement game device using an elastic projector to propel soft projectiles to a stationary target.

2. Description of Prior Art

This invention relates to games in which players attempt to hit designated points or orifices on a fixed target to achieve the highest score, thereby winning the game. U.S. Pat. Nos. 3,701,531: 3,814,428: 5,165,694: 5,294,129, and 5,622,369, the disclosures of which are incorporated therein by reference all relate to projectiles thrown by hand or by a hand-held projecting device at a designated target.

However, these games and embodiments are best suited to be played outdoors, as the composite material of the projectiles themselves dictate that fact.

My invention of the two-part embodiment target game is strictly and unequivocally designed to be played indoors or in a controlled environment. The lightweight composite target and the existing art soft foam balls indicate indoor use only.

SUMMARY OF THE INVENTION

The present invention provides an indoor interactive target game using a leg and hand held elastic cylindrically beaded sling to propel soft indoor foam or foam-type balls at a lightweight composite affixed target with a plurality of point indicia marked scoring opportunities.

OBJECTS AND ADVANTAGES

1. It is an object of my present invention to create a competitive interactive target game using four-inch diameter soft foam balls already in the current marketplace as propelled projectiles in this game.

a. It is a further object of my invention to be marketed in two-part embodiment form with the future trademark name of Couchpatata.

b. It is a still further object of my invention to provide a target game that will be easy and inexpensive to manufacture.

2. An advantage of my present invention is the fact that indoor soft foam composite balls have already been proven to be a safe projectile to be thrown or propelled indoors.

a. It is a further advantage of my invention in that the target mounts quickly and easily on any vertical wall surface of any composite type.

b. It is a still further advantage of my invention in that the soft projectiles can be launched by a player either lying on a piece of furniture or on the floor.

c. A still further advantage of my invention is the number of variations of the game that can be played to reach the highest point total. More objects and advantages will be readily apparent after a perspective of the following description and drawings.

DESCRIPTION OF DRAWING FIGURES

REFERENCE NUMERALS IN DRAWINGS

| | |
|---|---|
| 6 Foot and leg sling elastic fabric cord | 18 Four inch (height) elliptical bulls eye slot |
| 8 Elastic pocket (ball) area | 20 Flared catch basin |
| 10 Elastic handhold area | 22 Ten inch diameter plastic hoop and fabric netting sock (closed bottom) existing art |
| 12 Four inch diameter soft foam ball-existing art | 24 Plastic to cardboard mounting adaptor-existing art |
| 14 Elastic foothold (two) | 26 Plastic swivel catch bar |
| 16 Five inch (height) elliptical scoring slots (two) - color code defined | 28 Swivel point (two) |
| | 30 Compartment dividing walls composite - (interior-two) |

DESCRIPTION AND OPERATION

Figure 1:
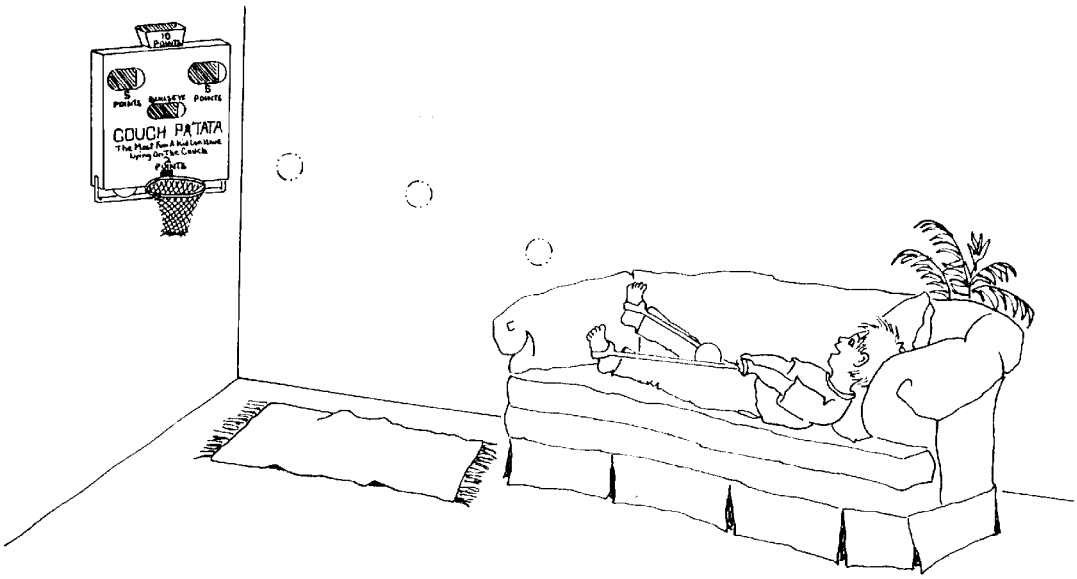
FIG. 1 is a perspective of the game embodiments, as they would appear in the process of being played by one shown contestant.
Figure 2:
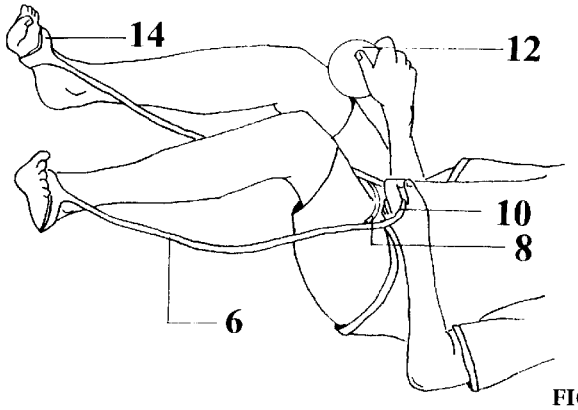
FIG. 2 shows the foot and leg elastic fabric sling fitting a contestant in its unstretched position.
Figure 3:
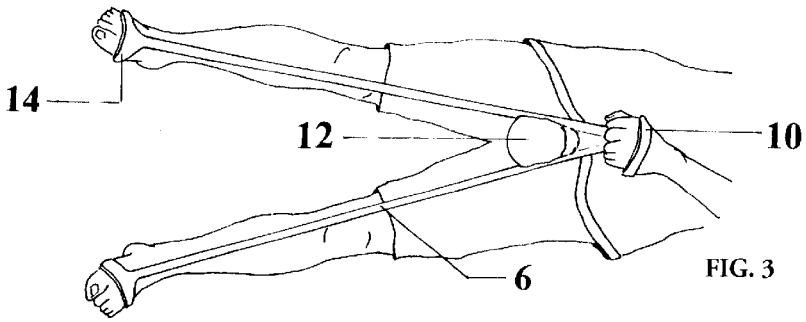
FIG. 3 shows the foot and leg elastic fabric sling holding a soft ball projectile in the pocket area in a stretched position.

A preferred embodiment of the foot and leg sling is illustrated in FIG. 2 and FIG. 3. The sling will be elastic fabric in cylindrical beaded form approximately three feet in length in its unstretched position. At the sling's dimensional midpoint, it will contain a wider flat band of elastic fabric forming the pocket area 8 that will be of sufficient size to easily accommodate the placing of a four inch foam ball 12 at and in that midpoint spot. At each end point of sling 6 there will be an elastic loop 14 of sufficient size to slide over and snugly fit a bare or socked human foot. The pocket 8 will contain an elastic beaded handhold 10 on the backside of pocket 8. The foot and leg sling 6 will be one continuous molded strip of lightweight elastic cylindrical beaded cord with a wider flat midpoint pocket area.

Figure 4:
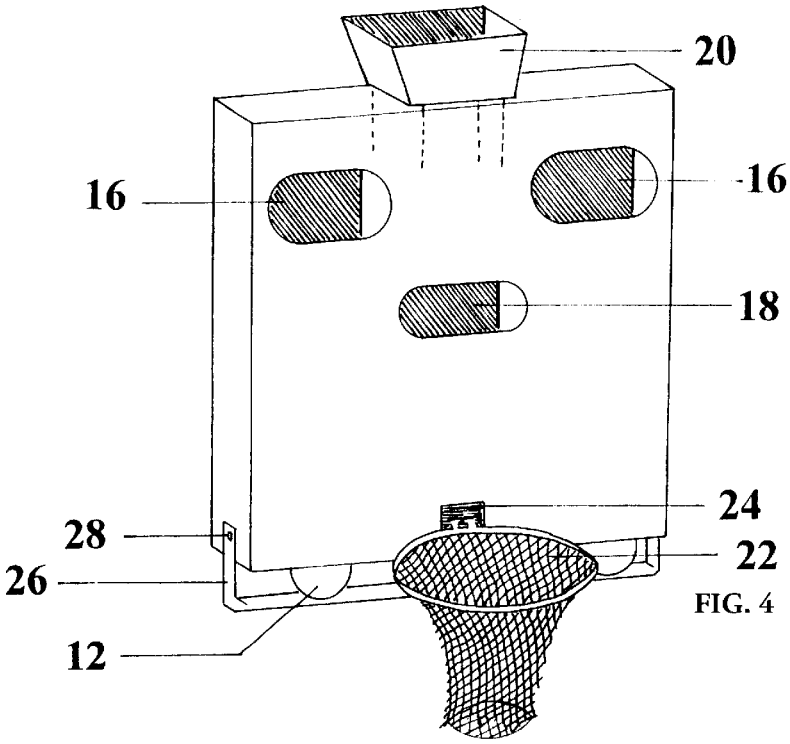
FIG. 4 is an isometric front view of the arcade-type lightweight composite target showing elliptical orifices, a raised tapered catch basin on top of target showing bottom of catch basin open to middle compartment ball collection area (hidden lines), a plastic hoop and fabric netting sock, and the ball collection point plastic swivel bar at bottom of target.
Figure 5:
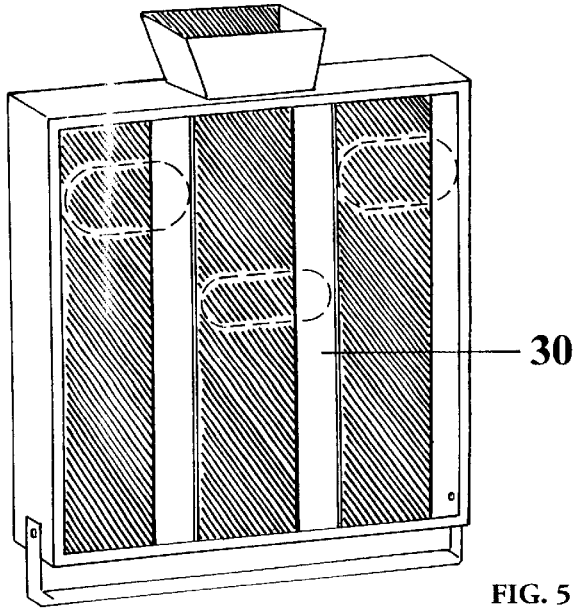
FIG. 5 is an isometric view of the same target with transparent front face showing the light composite interior vertical dividing walls (two), creating three ball collection compartments concurrent from top to bottom of target (ball collection swivel bar).

A preferred embodiment of the lightweight composite target is illustrated in FIG. 4 and FIG. 5. The target FIG. 4 contains four scoring opportunities of four varying degrees of difficulty on its front facade. The target FIG. 4 will be of sufficient size to accommodate all four scoring opportunities without crowding or close spacing; minimum twenty-eight inches square. Two elliptical holes 16 are cut in the front facade at locations shown; upper right and left hand corners, for indicia marked point score. An elliptical hole 18 is cut in front facade at the approximate center of the square target for a bulls eye indicia marked score. The elliptical shape of the holes or slots assures a possible score from any angle of the soft ball projectile launch in relation to the fixed target.

On the horizontal flat surface of the top of the target FIG. 4, an indicia marked catch basin 20 with a raised outwardly tapered front and two sidewalls will be incorporated at the target's top midpoint. A flat vertical backwall on the catch basin 20 will assure a rigid and a flush fit in a congruent manner with the flat back plane of target FIG. 4. The bottom of the catch basin 20 will be open to the interior core of target FIG. 4 in its center compartment section as shown by the hidden lines at the bottom of, catch basin 20 in drawing FIG. 4 of target embodiment.

A lightweight plastic hoop and sock with a closed or woven bottom will be mounted at the bottom center of target FIG. 4 at the approximate location shown. The plastic hoop and sock 22 (prior art) will be attached or mounted to the front facade of the target FIG. 4 by the use of a plastic adaptor 24 (prior art). The hoop and sock 22 scoring opportunity will be indicia marked.

The target FIG. 4 will have approximately six inches of depth, from the front facade to the rear backwall, to accommodate a four inch soft ball 12 and to allow it to fall freely after it enters one of the target's scoring orifices, to the plastic swivel collection or catch, bar 26 at the bottom of the target FIG. 4. As the two interior dividing walls 30 shown in FIG. 5 creates three separate compartments of soft ball storage and dividage, it will be a simple process of adding (or subtracting) the point total that the soft balls have scored through the corresponding orifice or slot in that particular compartment at the plastic catch bar 26. The plastic catch bar 26 holds the soft foam balls 12 in their respective compartment until the catch bar 26 is grasped and rotated frontward and upward by hand. The two swivel points 28 allow the plastic catch bar 26 to rotate and allows the foam balls 12 to drop out freely. The catch bar 26 is then rotated back down to its collection or catch position.

The plastic pivot will not be limited in the scope of pivot rotation and will be accomplished in a manner typical or commonly done, or otherwise known as the industry standard for a lightweight pivot point.

RAMIFICATIONS AND SCOPE

This game invention containing the two-part embodiment described will be marketed and sold in a kit form. It will also contain printed instructions for, fastening the lightweight composite target to any vertical wall surface and a basic instruction on how the game is played and some possible variations thereof.

The target mounts to any standard composite interior wall by the use of long barbed thumbtacks (not shown) that will be included in the game kit. As the preferred embodiment composite material of the target is corrugated or hard surface cardboard, it will simply be a matter of pushing the long barbed thumbtacks through the back wall cardboard of the target at its two upper right and left hand elliptical holes and at any two points at the open bottom of the target. Pushing or lightly tapping with a small hammer will succeed in pushing the steel point barb into the wall composite (gypsum drywall) of any typical interior wall. If a more secure bond to the interior wall is recognized the installer of the target can readily find the interior structure components of the interior wall (wood studs) and tap the long barbed thumbtacks through the back of the target into those components, assuring a positive fastening method to the wall.

The instruction sheet will also recommend the installer to mount the target at a distance approximately two feet vertically below the ceiling-wall line in the room that is to be played in. This will assure that rebounding off of the ceiling by the propelled foam balls will be an option by the players in their attempt to score points at the orifice openings. Rebounding the foam balls, either off of the ceiling or off of a right or left hand corner wall in the room, will be an important element of the game.

Since the preferred composite material of the target is cardboard, the pointed long barbed thumbtacks will provide all the fastening and weight bearing adhesion to the vertical flat wall it is mounted to. The thumbtacks also assure minimal surface wall damage in the event that the target is moved to another location. The hook and loop fastening method to a vertical wall surface aforestated in my Provisional Patent Application is hereby abandoned and deemed unnecessary due to my prototype application trial.

The foot and leg sling will be quickly apparent to each player on its method of use and operation, as follows:

Both players slip the elastic footholds over the front of both of their feet, recline on their backs on a piece of furniture or on the floor of the room, pointing and elevating the legs towards the target, slightly spread the feet apart, grasp the handhold at the pocket area and pullback to the crotch or groin area, place a foam ball in the sling's pocket, aim at target and release handhold whereby propelling the foam ball to the target as the sling contracts to its unstretched state. (Note: In FIG. 3, the elastic handhold 10 is shown around player's hand. This is for a clear illustrative view of the handhold. Finger gripping will be sufficient.)

The method of using the foot and leg sling will quickly be mastered by the contestants.

As an interactive game of scoring to a predetermined highest point total, two players each outfitted with a foot and leg sling, will be needed to make this game fast, exciting, and competitive. For that reason, two sets of color coated foam balls will be used in the game, one set of approximately eight foam balls per player, to be launched by each player assigned with their respective color, at the target. The colored foam balls will allow for easy point determination per contestant during the course of the game. The colored foam balls also become a factor of the game in that each player has their own elliptical slot, located right or left hand upper corner of the target, color coded to their respective ball color, to propel at. In the event that a player inadvertently puts their foam ball in their opponent's elliptical slot (opponent's color), that indicia point amount per number of balls will be subtracted from that player's point total.

The catch basin on the top of the target is a common orifice for both players to launch to as is the bulls eye elliptical slot, which is also open to the center interior compartment of the target. Players of the game will quickly surmise that it will take a "soft" shot or launch to catch the four inch foam ball in the four inch elliptical hole for a bulls eye and end to the game or a round in the game. If the ball travels through the bulls eye slot to the interior center compartment, that player will receive the indicia point score that the catch basin carries to keep the center collection compartment clarified in the point total per color of balls sorted in that compartment at the bottom catch bar.

The plastic hoop and closed bottom sock will hold and contain the color coated foam balls for an easy point determination per player.

As an added benefit, this interactive game will have many variations of play, which will be suggested to enhance it, as follows:

One and the same person is employed by each contestant to gather and return the foam balls to each player whom can then remain at their position (point) of launch, for a fast paced game.

Players can switch colored balls (launch opponents foam balls) between rounds of play.

If the room to be played in is large enough for two targets and four players, two person teams can be chosen, launching the foam balls "cross-target", whereby the flight to the target of the opponent's foam balls cross the plane of each other, creating collisions of the balls in-flight, which introduces a whole new competitive element to the game. Deliberate "shooting down" of an opponent's foam ball will be an important and integral part of the game. This type of interactive action in a fast-paced game such as this will be embraced by the contestants who play it.

These are but a few of the examples of how this interactive game can be expanded and played but in no way is it to be confined to any set of variations. The game's limitations and variations will only be subject to the restraints and rules set forth by the players themselves, as many more subsets of the game are possible.

As this interactive game is designed for indoor use of play only and geared specifically towards children's indoor mode of safe competitive game playing, it will be appreciated by children and parents alike.

The specifications therein explained and expanded upon should not be construed as a limitation of the scope of this game invention nor should the composite material of either of the two preferred embodiments that together compose the total game package be limited in any way or type of formation.

I claim:

1. An indoor target game comprising in combination:

a) an indoor target made of a lightweight material of a predetermined size containing a plurality of indicia marked scoring openings; said target having sufficient space between the front face of said target and rear wall of said target to permit projectiles to be collected and moved by gravity to a collection point within said target.

b) a plurality of soft foam or fabric filled projectiles; each projectile has a numeric dimensional diameter in a defined range between two(2) and five(5) inches inclusively.

c) a lightweight elastic cord for propelling said projectiles: said elastic cord having a center portion containing a pocket and handhold area and two ends, each having a looped end thereon;

each of the two looped ends being of a sufficient size so that they may be removably attached to the each of a player's feet and the center portion being of a length to project the projectile towards said target when said cord is drawn back and stretched by the player's hand.

2. The target of claim 1 further comprising an interior compartment divided by vertical membranes of the same target material affixed to front face and the rear wall of target.

3. The target of claim 1 wherein the lightweight material is comprised from the group consisting of corrugated or hard surfaced cardboard.

4. The target of claim 1 further comprising a plurality of scoring openings which includes a hoop and sock affixed to face of target at a predetermined location.

* * * * *